US011098605B2

(12) United States Patent
Camillieri

(10) Patent No.: US 11,098,605 B2
(45) Date of Patent: Aug. 24, 2021

(54) RIM SEAL ARRANGEMENT

(71) Applicant: Siemens Aktiengesellschaft, Munich (DE)

(72) Inventor: Stephen A. Camillieri, Fort Mill, SC (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 1 day.

(21) Appl. No.: 16/640,631

(22) PCT Filed: Aug. 9, 2018

(86) PCT No.: PCT/US2018/046026
§ 371 (c)(1),
(2) Date: Feb. 20, 2020

(87) PCT Pub. No.: WO2019/040291
PCT Pub. Date: Feb. 28, 2019

(65) Prior Publication Data

US 2020/0355086 A1 Nov. 12, 2020

Related U.S. Application Data

(60) Provisional application No. 62/548,649, filed on Aug. 22, 2017.

(51) Int. Cl.
*F01D 11/00* (2006.01)
*F01D 5/18* (2006.01)

(52) U.S. Cl.
CPC ..... *F01D 11/001* (2013.01); *F01D 5/187* (2013.01); *F05D 2240/55* (2013.01); *F05D 2260/201* (2013.01)

(58) Field of Classification Search
CPC ..... F01D 11/001; F01D 5/187; F01D 9/041
See application file for complete search history.

(56) References Cited

U.S. PATENT DOCUMENTS 8,851,845 B2 * 10/2014 Brittingham ..... F01D 9/02 416/96 R
10,358,927 B2 * 7/2019 Okajima ..... F02C 7/18
(Continued)

FOREIGN PATENT DOCUMENTS

| | | | |
|---|---|---|---|
| EP | 0875665 | A2 | 11/1998 |
| EP | 2844843 | A1 | 3/2015 |
| JP | H11270353 | A | 10/1999 |

OTHER PUBLICATIONS

PCT International Search Report and Written Opinion dated Nov. 12, 2018 corresponding to PCT Application No. PCT/US2018/046026 filed Aug. 9, 2018.

*Primary Examiner* — Eldon T Brockman

(57) ABSTRACT

A seal arrangement for a turbine stage includes a vane assembly including radially inner and outer vane platforms and an airfoil. The seal arrangement further includes a rim seal feature including forward and aft rim seal legs extending radially inward from a radially inward surface of the radially inner vane platform. An impingement plate covers the radially inward facing surface of the radially inner vane platform and extends axially aft up to the aft rim seal leg. A rim seal containment structure is located radially inward of the impingement plate and extends axially over the aft portion of the radially inner vane platform up to the aft rim seal leg. A cooling cavity is defined between the rim seal containment structure and the impingement plate and extends axially aft up to the aft rim seal leg to provide cooling to an aft portion of the radially inner vane platform.

14 Claims, 6 Drawing Sheets

(56) References Cited

U.S. PATENT DOCUMENTS

| | | | | |
|---|---|---|---|---|
| 2012/0121415 | A1* | 5/2012 | Brittingham | F01D 5/186 416/95 |
| 2015/0071761 | A1 | 3/2015 | Headland | |
| 2016/0201472 | A1* | 7/2016 | Okajima | F01D 25/246 415/177 |

* cited by examiner

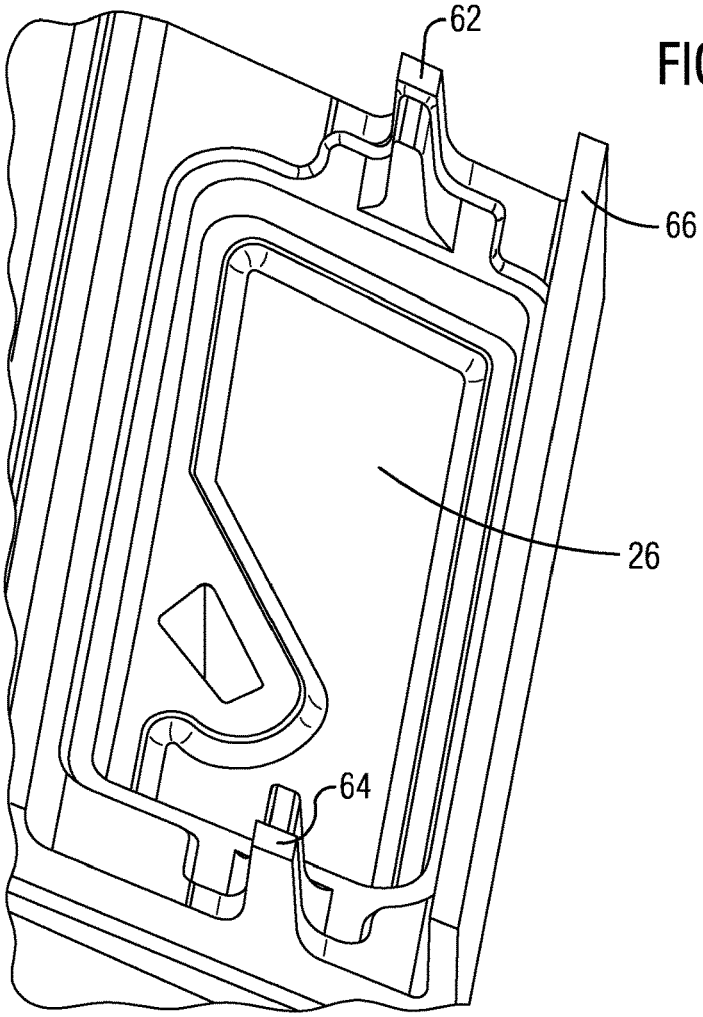
FIG. 9
FIG. 11
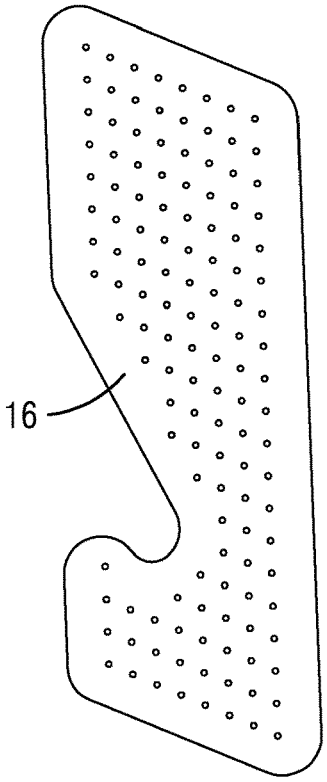
FIG. 10
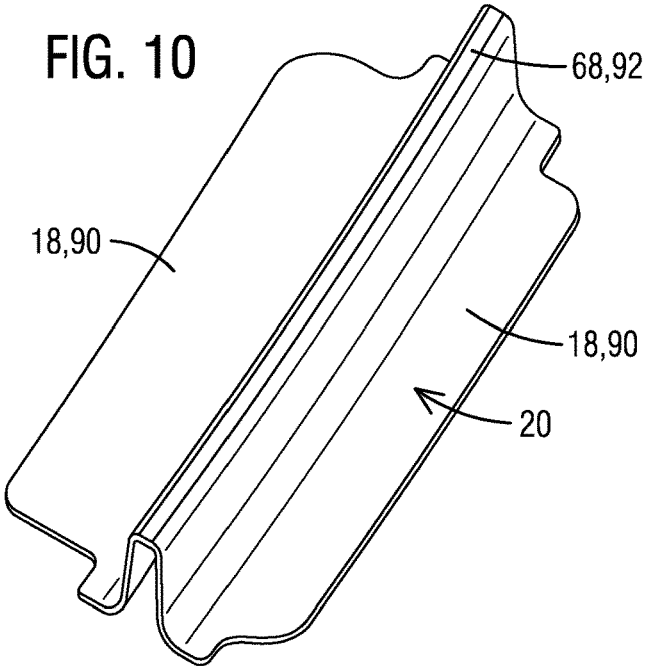

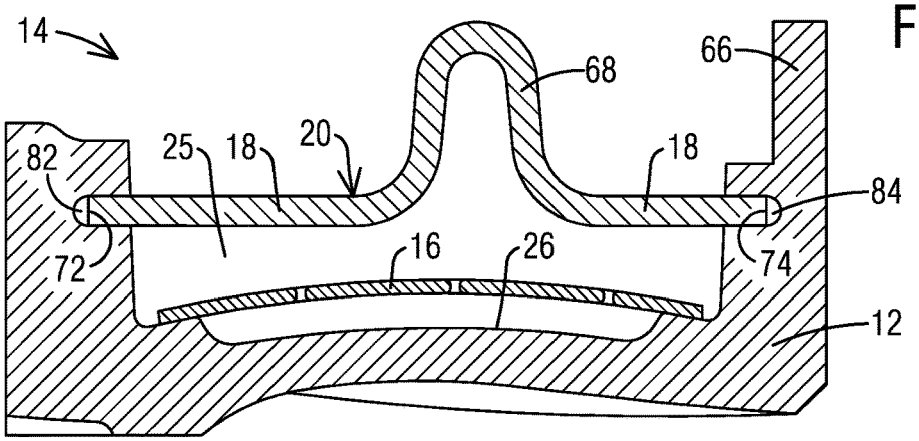
FIG. 12
FIG. 13
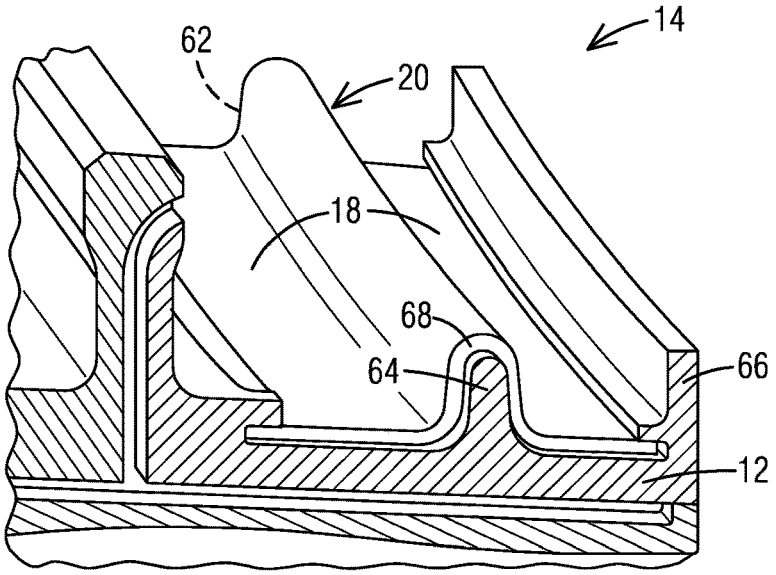
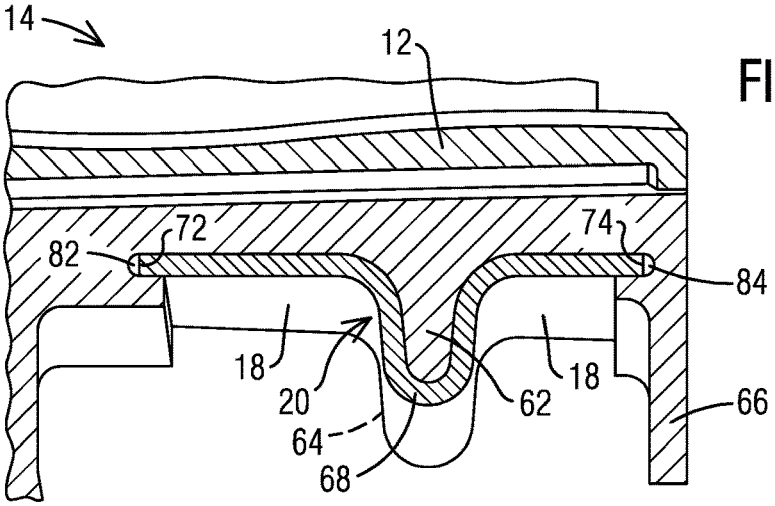
FIG. 14

RIM SEAL ARRANGEMENT

CROSS-REFERENCE TO RELATED APPLICATIONS

The present application claims priority to the U.S. Provisional Application No. 62/548,649, filed on Aug. 22, 2017, the content of which is herein incorporated by reference in its entirety.

BACKGROUND

1. Field

The present invention relates to gas turbine engines, and more specifically to a rim seal arrangement for a turbine blade in a gas turbine engine.

2. Description of the Related Art

In an industrial gas turbine engine, hot compressed gas is produced. A combustion system receives air from a compressor and raises it to a high energy level by mixing in fuel and burning the mixture, after which products of the combustor are expanded through a turbine. The hot gas flow is passed through the turbine and expands to produce mechanical work used to drive an electric generator for power production. The turbine generally includes multiple stages of stator vanes and rotor blades to convert the energy from the hot gas flow into mechanical energy that drives the rotor shaft of the engine. Turbine inlet temperature is limited to the material properties and cooling capabilities of the turbine parts. This is especially important for upstream stage turbine vanes and blades since these airfoils are exposed to the hottest gas flow in the system.

Both the turbine section and the compressor section have stationary or non-rotating components, such as vanes, for example, that cooperate with rotatable components, such as blades, for example, for compressing and expanding the hot working gas. Many components within the machines must be cooled by a cooling fluid to prevent the components from overheating.

The turbine section typically includes alternating rows of turbine vanes and turbine blades. The vanes and blades each project from respective platforms that when assembled form vane and blade rings. The vane and blade rings each have rims that generally oppose one another and define at least in-part a cooling cavity therebetween.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components. Flow of cooling air through the cavity located in-part between the blade and vane rings can cool adjacent components.

Ingestion of hot working gas from a hot gas path into disc cavities in the machines that contain cooling fluid reduces engine performance and efficiency, e.g., by yielding higher disc and blade root temperatures. Ingestion of the working gas from the hot gas path into the disc cavities, such as through a rim seal may also reduce service life and/or cause failure of the components in and around the disc cavities.

SUMMARY

According to a first aspect of the invention, a seal arrangement for a turbine engine is provided. The seal arrangement comprises a non-rotatable vane assembly including a vane. The vane includes a radially inner vane platform and a radially outer vane platform. The radial inner vane platform has a radially outward facing surface, a radially inward facing surface, a forward portion, and an aft portion. The vane further comprises an airfoil including a pressure side surface and an opposite suction side surface generally extending axially from a leading edge to a trailing edge of the airfoil, and radially from an inner diameter base to an outer diameter tip. The airfoil is positioned between and joined to the radially inner vane platform and radially outer vane platform. The seal arrangement further comprises a rim seal feature. The rim seal feature comprises a forward rim seal leg comprising a pressure side tab and a suction side tab. Each tab is positioned at a circumferential edge of the radially inward facing surface of the radially inner vane platform, and extends radially inward from the airfoil of the vane. The rim seal feature also comprises an aft rim seal leg extending along the length of the radially inward facing surface of the radially inner vane platform circumferentially from a pressure side to a suction side of the radially inner vane platform. The aft rim seal leg extends radially inward from the airfoil of the vane at an aft end of the radially inner vane platform. An impingement plate covers the radially inward facing surface of the radially inner vane platform and extends axially aft up to the aft rim seal leg. A rim seal containment structure is located radially inward of the impingement plate. The rim seal containment structure comprises a cap portion extending axially over the aft portion of the radially inner vane platform up to the aft rim seal leg. The rim seal containment structure further comprises a leg portion extending radially inward from the cap portion and positioned axially between a forward edge and an aft edge of the cap portion. The leg portion extends in a circumferential direction between the pressure side tab and the suction side tab, such that the leg portion of the ring seal containment structure, the pressure side tab and the suction side tab, in combination, form the forward rim seal leg. The forward rim seal leg, the radially inward facing surface of the radially inner vane platform and the aft rim seal leg define a rim cavity. A cooling cavity is defined between the rim seal containment structure and the impingement plate, the cooling cavity extending axially aft up to the aft rim seal leg, to provide cooling to the aft portion 58 of the radially inner vane platform.

According to a second aspect of the invention, a turbine stage for a gas turbine engine is provided. The turbine stage comprises a vane assembly defined about an axis. The vane assembly comprises a radially inner vane platform and a radially outer vane platform. The radially inner vane platform has a radially outward facing surface, a radially inward facing surface, a forward portion, and an aft portion. An airfoil extends between the radially inner vane platform and the radially outer vane platform. The turbine stage further comprises a rim seal feature. The rim seal feature comprises a forward rim seal leg comprising a pressure side tab and a suction side tab. Each tab is positioned at a circumferential edge of the radially inward facing surface of the radially inner vane platform, and extends radially inward from the airfoil of the vane. The rim seal feature also comprises an aft rim seal leg extending along the length of the radially inward facing surface of the radially inner vane platform circumferentially from a pressure side to a suction side of the radially inner vane platform. The aft rim seal leg extends radially inward from the airfoil of the vane at an aft end of the radially inner vane platform. An impingement plate covers the radially inward facing surface of the radially inner vane platform and extends axially aft up to the aft rim seal leg. A rim seal containment structure is located radially inward of the impingement plate. The rim seal containment structure comprises a cap portion extending axially over the aft portion of the radially inner vane platform up to the aft rim seal leg. The rim seal containment structure further comprises a leg portion extending radially inward from the cap portion and positioned axially between a forward edge and an aft edge of the cap portion. The leg portion extends in a circumferential direction between the pressure side tab and the suction side tab, such that the leg portion of the ring seal containment structure, the pressure side tab and the suction side tab, in combination, form the forward rim seal leg. The forward rim seal leg, the radially inward facing surface of the radially inner vane platform and the aft rim seal leg define a rim cavity. A cooling cavity is defined between the rim seal containment structure and the impingement plate, the cooling cavity extending axially aft up to the aft rim seal leg, to provide cooling to the aft portion 58 of the radially inner vane platform. The turbine stage further comprises a blade assembly disposed axially downstream of the vane assembly. The blade assembly includes a blade platform comprising an angel wing extension having a distal end projecting in the upstream direction spaced radially inward from the aft portion of the radially inner vane platform.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

FIG. 9 is a perspective view of a vane casting and machining geometry prior to addition of a rim seal assembly of an exemplary embodiment of the present invention;

FIG. 10 is a perspective view of a rim seal containment structure of an exemplary embodiment of the present invention;

FIG. 11 is a perspective view of an impingement plate of an exemplary embodiment of the present invention;

FIG. 12 is a cross-sectional side view, looking in a tangential direction, of a rim seal assembly according to a second variant of the invention;

FIGS. 13 and 14 are perspective views of the rim seal assembly shown in FIG. 12.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a rim seal arrangement for turbine engines includes a vane assembly including a radially inner vane platform, a radially outer vane platform, and a airfoil. The radially inner vane platform includes a rim seal feature along a radially inward facing surface having a forward rim seal leg that includes a pressure side tab and a suction side tab, and an aft rim seal leg covering a trailing edge end of the inner vane platform radially inward facing surface. An impingement plate covers an aft portion of the radially inner vane platform and a rim seal containment structure covers the area between the impingement plate and forward rim seal leg radially inward and covers the aft portion of the radially inner vane platform.

A gas turbine engine may comprise a compressor section, a combustor and a turbine section. The compressor section compresses ambient air. The combustor combines the compressed air with a fuel and ignites the mixture creating combustion products comprising hot gases that form a working fluid. The working fluid travels to the turbine section. Within the turbine section are circumferential rows of vanes and blades, the blades being coupled to a rotor. Each pair of rows of vanes and blades forms a stage in the turbine section. The turbine section comprises a fixed turbine casing, which houses the vanes, blades and rotor. A blade of a gas turbine receives high temperature gases from a combustion system in order to produce mechanical work of a shaft rotation.

Vanes and blades, especially in the earlier stages of the turbine engine, see high temperatures. The vanes and blades each project from respective platforms that when assembled form vane and blade rings. The vane and blade rings each have rims that generally oppose one another and define at least partially a cooling cavity there between. The vanes extend into a rim cavity formed between two stages of the rotor blades.

Figure 1:
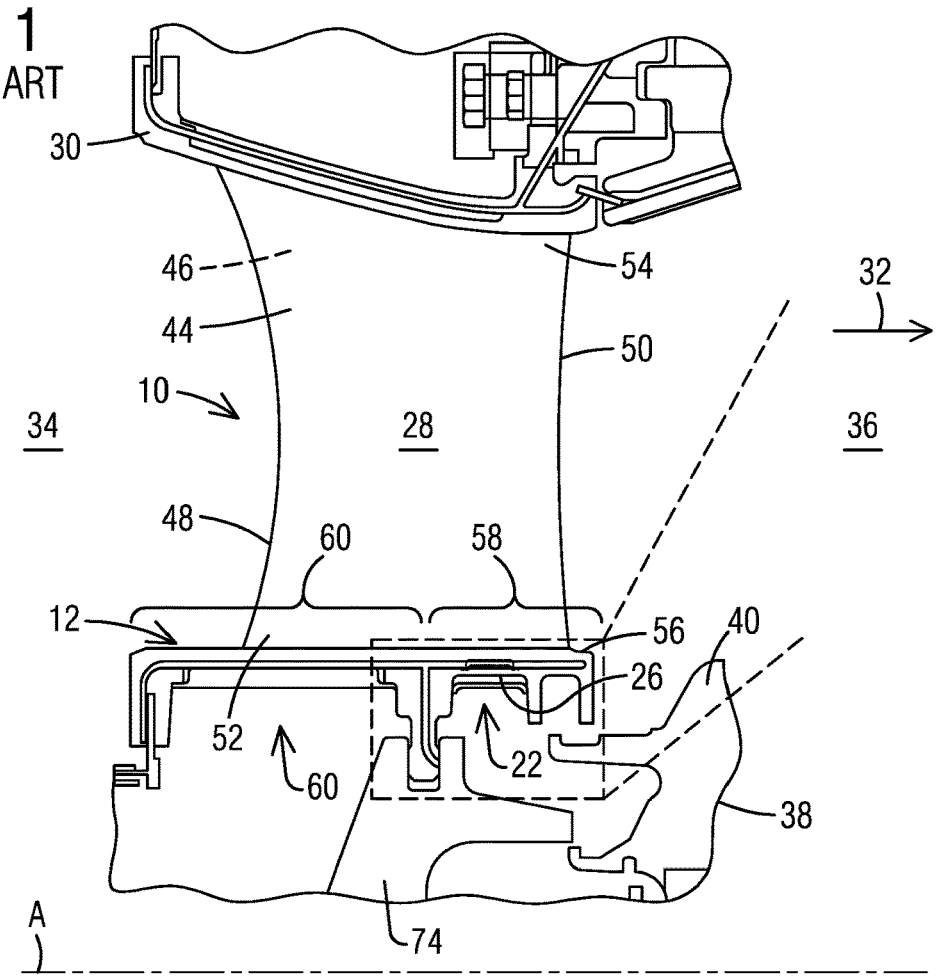
FIG. 1 PRIOR ART
FIG. 1 is a side view of a portion of a turbine engine including a rim seal assembly of an exemplary embodiment of the present invention.

In the present description, the terms "radial" and its derivatives, and the term "axial" and its derivatives are defined in relation to a rotation axis or engine axis A, as depicted in FIG. 1. The terms "forward" (or "upstream") and "aft" (or "downstream") are defined in relation to a flow direction of a working hot gas fluid, which is generally in the axial direction.

Figure 2:
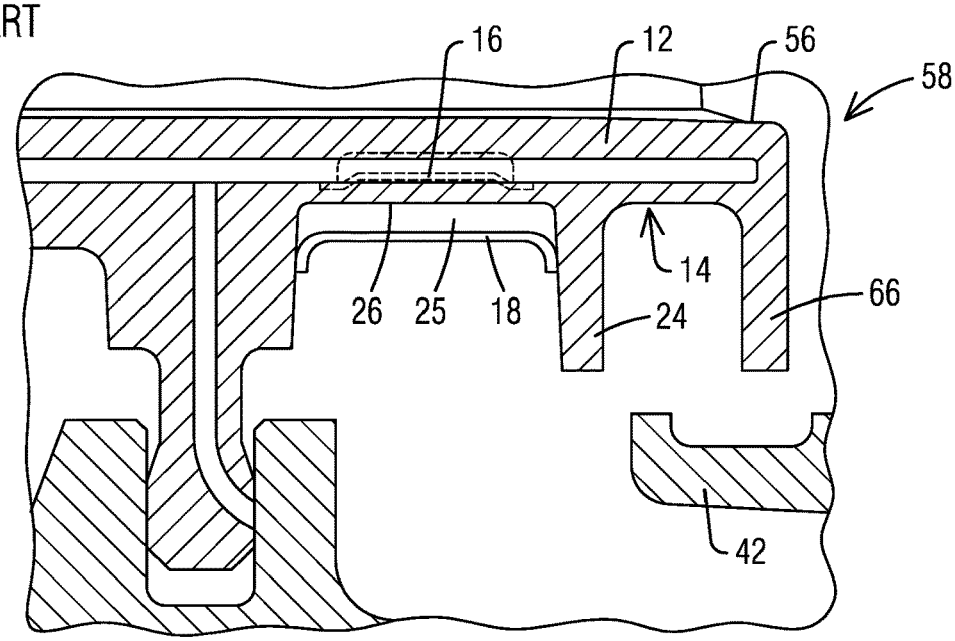
FIG. 2 PRIOR ART
FIG. 2 is a detailed view of a portion of FIG. 1.

FIGS. 1 and 2 illustrate a known type of turbine vane 10 in a turbine stage of a gas turbine engine. The vane 10 assembly includes a radially inner vane platform 12 and a radially outer vane platform 30. An airfoil 28 extends span-wise in a radial direction between the radially inner and radially outer vane platforms 12, 30, being joined to the platforms 12, 30 at opposite ends of the airfoil 28. The airfoil 28 includes a pressure side surface 44 (front) and an opposite suction side surface 46 (back). The pressure side surface 44 and suction side surface 46 generally extend axially from a leading edge 48 to a trailing edge 50 of the vane airfoil 28 and radially from an inner diameter (ID) or base 52 to an outer diameter (OD) or tip 54.

The radially inner vane platform, or ID vane platform 12, includes a radially outward facing surface 56 that connects to the ID base 52 of the vane airfoil 28 and defines an inner diameter boundary of a working hot gas flow path 32. The ID vane platform 12 further includes a radially inward facing surface 26. The ID vane platform 12 comprises a forward portion 60 and an aft portion 58, the aft portion 58 extending partially downstream of the base 52 of the vane airfoil 28. The aft portion 58 of the ID vane platform 12 is further detailed below.

A rotatable blade 38 is shown positioned axially downstream, or aft, of the vane 10. The blade 38 includes a blade platform 40. The blade platform 40 includes an angel wing extension 42 having a distal end that projects in the upstream, or forward direction. A portion of the angel wing extension 42 of the blade platform 40 of the blade 38 may overlap the aft portion 58 of the ID vane platform 12, so that the upstream distal end of the angel wing extension 42 is positioned radially inward from the aft portion 58 of the ID vane platform 12.

A rim cavity 22 is formed radially inward from the ID vane platform 12 at the aft portion 58 thereof. The angel wing extension 42 from the adjacent blade platform 40 is positioned radially inward of the rim cavity 22. The radially inward facing surface 26 of the ID vane platform 12 includes a rim seal feature 14 at the aft portion 58 of the ID vane platform 12. The rim seal feature 14 interacts with the angel wing extension 42 of the blade platform 40 to seal the rim cavity 22, to reduce leakage, and improve engine performance.

The above described rim seal feature 14 provides a cooling challenge since it takes up space on the aft end of the vane ID platform 12 where there is no supply of coolant. The temperature of the trailing edge 50 of the vane airfoil 28 is generally higher than the leading edge 48 due to cooling that takes place upstream of the trailing edge 50. This poses a challenge of cooling the aft portion 58 of the ID vane platform 12. The aft portion 58 of the ID vane platform 12 may comprise a cooling cavity 25, which may be supplied with a coolant, for example, from an aft cooling channel (not shown) of the airfoil 28. As is shown in FIG. 2, conventionally, a containment cap 18 maybe welded or brazed to the ID vane platform 12 to cover cooling cavity 25. The coolant received in the cooling cavity 25 is then allowed to impinge on a backside of the vane ID platform 12, flowing radially outward, via a porous impingement plate 16, which may be welded or brazed thereto. With the rim seal feature 14 in place, however, there are no cooling channels over the rim seal feature 14 itself. Cooling holes may be drilled into the aft end of the ID vane platform 12 from the cooling cavity to the platforms. However, these cooling holes may reduce the efficiencies of the turbine engine. Embodiments of the present invention provide cooling to the aft portion 58 of the ID vane platform 12 with a modified rim seal feature 14 in place. The conventional rim seal feature 14 includes a forward rim seal leg 24 and an aft rim seal leg 66 that is completely cast into the vane 10 running the length from pressure side 44 to suction side 46.

In the configuration shown in FIGS. 1 and 2, the containment cap 18 covers the radially inward facing surface 26 of the ID vane platform 12 aft to the forward rim seal leg 24. The portion aft of the forward rim seal leg 24 is not be covered by the containment cap 18 or the impingement plate 16. To remedy this issue, embodiments show that the containment cap 18 and rim seal are now integrated.

Exemplary embodiments of the present invention are illustrated referring to FIGS. 3 to 14. As shown, a modified rim seal feature 14 includes a forward rim seal leg 24 comprising a pressure side tab 62 and a suction side tab 64 (e.g., see FIGS. 5 and 9). The term "tab" referred to here is a component that does not cover the full length (measured in in a circumferential direction) of the attached base. The tabs 62, 64 may be formed integrally with the ID vane platform 12, for example, by casting. The tabs 62, 64 are positioned at the same axial location, with each tab 62, 64 being positioned at a circumferential edge of the radially inward facing surface 26 of the ID vane platform 12. Each tab 62, 64 extends radially inward from the airfoil 28 of the vane. Further, an aft rim seal leg 66 is provided, which extends along the length (in a circumferential direction) of the radially inward facing surface 26 of the ID vane platform 12 from the pressure side to the suction side of the platform 12. The aft rim seal leg 66 extends radially inward from the airfoil 28 of the vane at an aft end of the ID vane platform 12. An impingement plate 16 covers the radially inward facing surface 26 of the ID vane platform, and extends axially aft up to the aft rim seal leg 66.

In accordance with aspects of the present invention, a rim seal containment structure 20 is located radially inward of the impingement plate 16. The rim seal containment structure 20 includes a cap portion 18 and a leg portion 68. The cap portion 18 extends axially over the aft portion 58 of the ID vane platform 12 up to the aft rim seal leg 66. The leg portion 68 extends radially inward from the cap portion 18 and positioned axially between a forward edge 72 and an aft edge 74 of the cap portion 18. The leg portion 68 extends in a circumferential direction between the pressure side tab 62 and the suction side tab 64. Thereby, the leg portion 68 of the rim seal containment structure 20, the pressure side tab 62 and the suction side tab 64, in combination, form the forward rim seal leg 24. The forward rim seal leg 24, the radially inward facing surface 26 of the ID vane platform 12 and the aft rim seal leg 66 define an approximately U-shaped cavity 22, which may be referred to as a "rim cavity". A cooling cavity 25 is defined between the rim seal containment structure 20 and the impingement plate 16. The cooling cavity 25 extends axially aft up to the aft rim seal leg 66, to provide cooling to the aft portion 58 of the ID vane platform 12.

In a first set of variants shown in FIG. 3-11, the cap portion 18 of the rim seal containment structure 20 is shaped to roughly match approximately the exterior geometry of the sides of the radially inward facing surface 26 of the ID vane platform 12 extending from the pressure side to the suction side thereof, covering over a space radially inward from the impingement plate 16. The rim seal containment structure 20 may be attached to the ID vane platform 12 by welding or brazing. The weld/braze joint is typically provided all around the rim seal containment structure 20, including at the interface with the tabs 62, 64, to prevent leakage. A cooling cavity 25 is formed between the impingement plate 16 and the rim seal containment structure 20.

Figure 3:
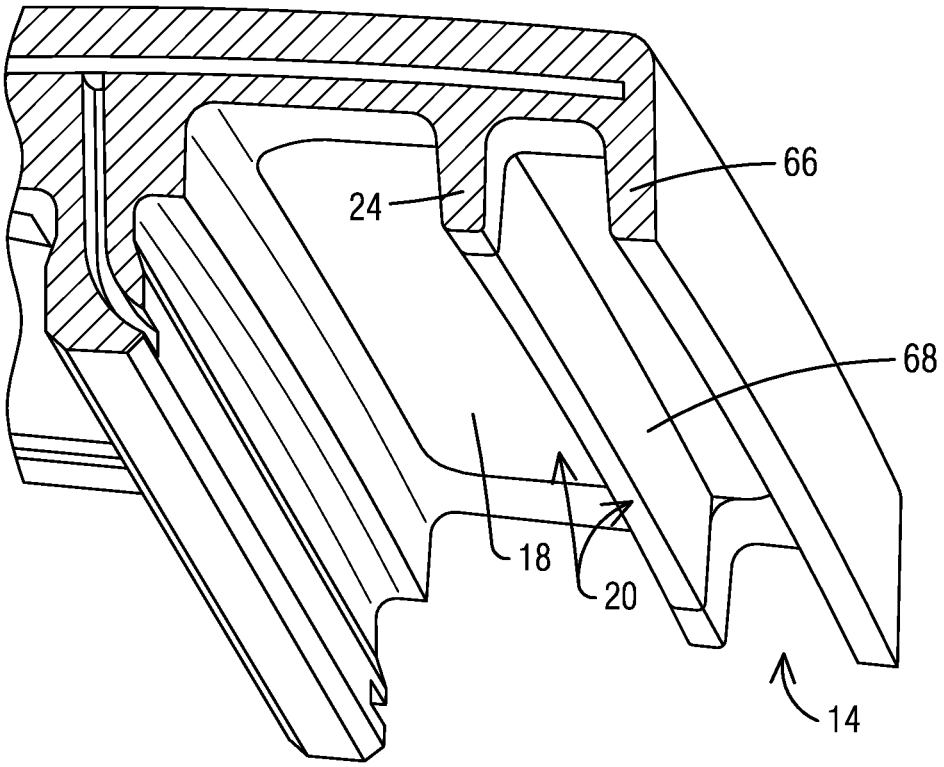
FIG. 3 is a perspective view in the radially outward direction of a rim seal assembly of an exemplary embodiment of the present invention in place on a vane/blade.
Figure 4:
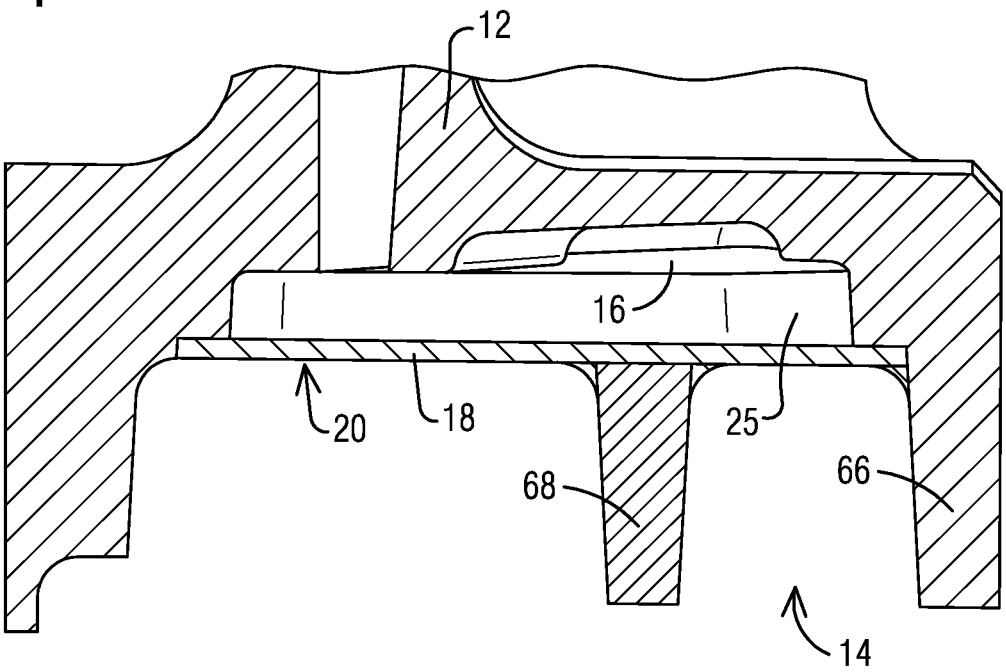
FIG. 4 is a side view of a rim seal assembly of an exemplary embodiment of the present invention.
Figure 5:
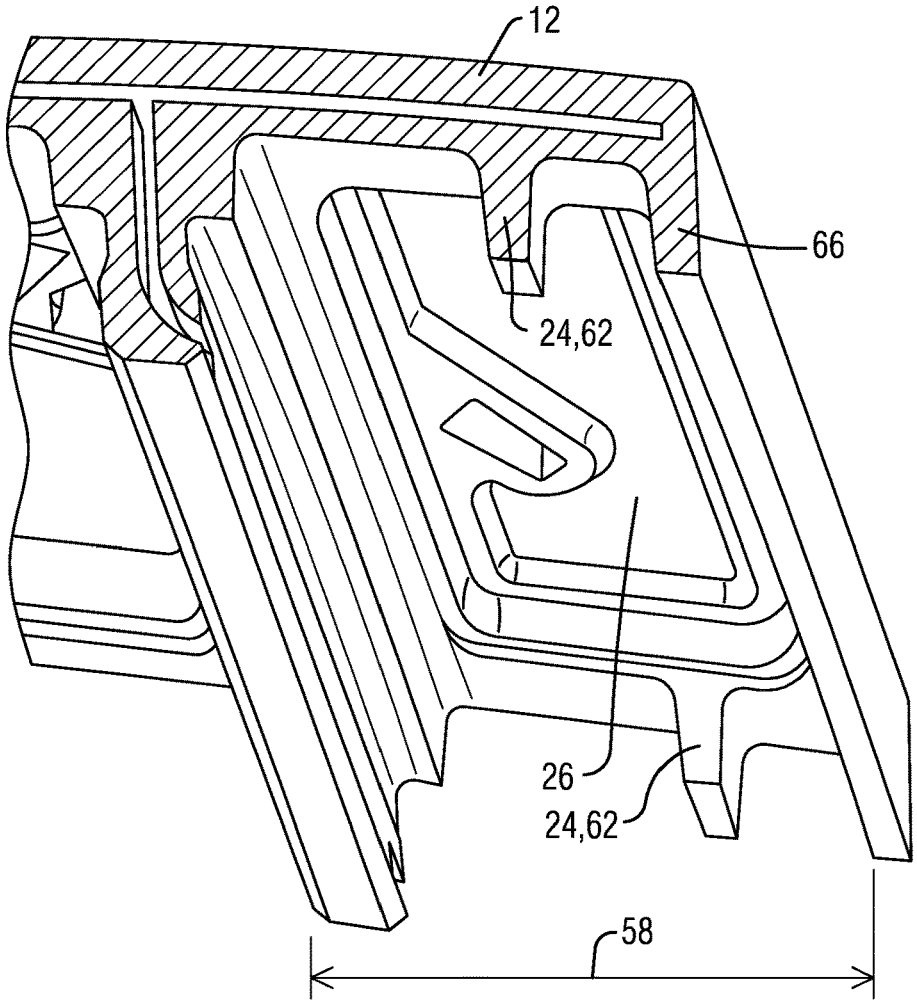
FIG. 5 is a perspective view in a radially outward direction of a rim seal assembly of an exemplary embodiment of the present invention in place on a vane/blade.

In one embodiment, as shown in FIG. 3-5, the rim seal containment structure 20 includes a cap portion 18 extending forward from the aft rim seal leg 66 to cover the aft portion 58 of the radially inward facing surface 26 of the ID vane platform 12. The cap portion 18 may include a flat surface, at a constant radial level. A leg portion 68 extends radially inward from the cap portion 18, and further extends circumferentially between the pressure side tab 62 and the suction side tab 64 of the forward rim seal leg 24. The leg portion 68 may, in this case, be joined to the cap portion 18, for example, by welding of brazing. FIG. 5 shows the radially inward facing surface 26 prior to the rim seal containment structure 20 assembly attachment. FIGS. 3 and 4 show the rim seal containment structure 20 with the cap portion 18 and the leg portion 68 assembled. The radial extent of the leg portion 68 may correspond to the radial extension of the tabs 62, 64.

Figure 8:
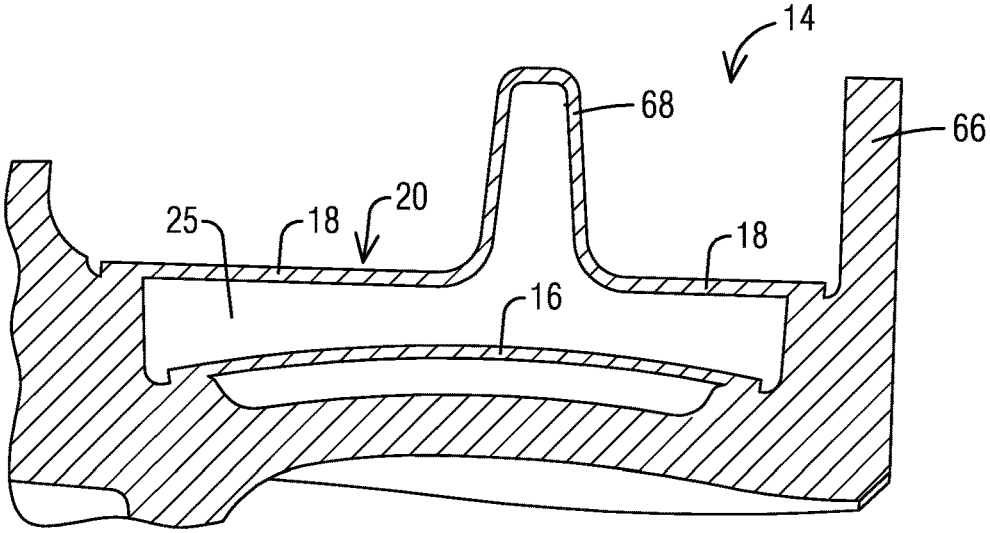
FIG. 8 is a cross-sectional side view, looking in a tangential direction, of a rim seal assembly of an exemplary embodiment of the present invention.
Figure 7:
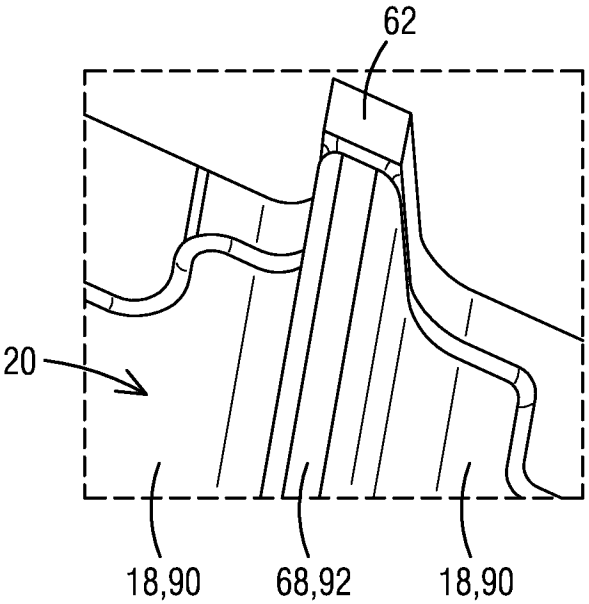
FIG. 7 is a detailed perspective view in the radially outward direction of a rim seal assembly of an exemplary embodiment of the present invention in place on a vane/blade.
Figure 6:
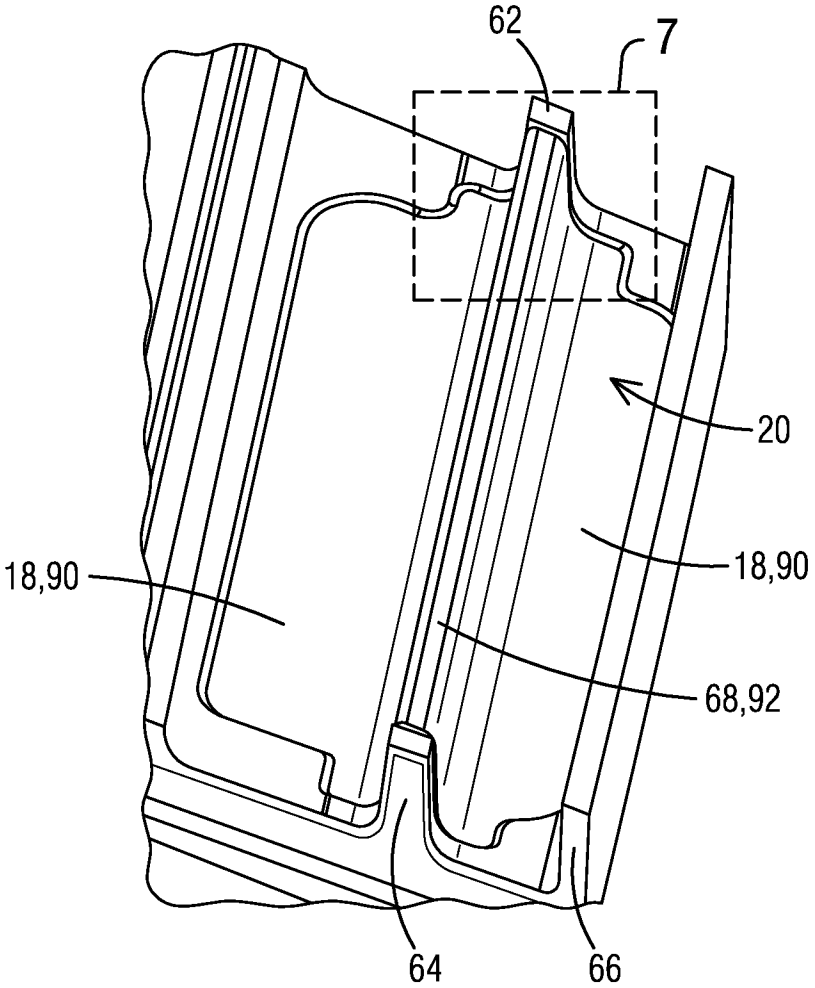
FIG. 6 is a perspective view in the radially outward direction of a rim seal assembly of an exemplary embodiment of the present invention in place on a vane/blade.

In another embodiment, as shown in FIG. 6-10, the rim seal containment structure 20 is constructed in one piece, from a monolithic sheet. The sheet comprises a first portion 90 located at a first radial level, which is configured as the cap portion 18. The sheet further comprises a second portion 92 bent radially inward from the first portion 90. The second portion 92 defines the leg portion. The second portion 92 may be axially located between the forward edge 72 and the aft edge 74 of the cap portion 18, and axially co-located with the pressure side tab 62 and the suction side tab 64. The radial extent of the leg portion 68 may correspond to the radial extension of the tabs 62, 64. FIG. 6-8 show the rim seal containment structure 20 assembled to an ID vane platform 12, FIG. 9 shows the radially inward surface of the ID vane platform 12 prior to the assembly of the impingement plate 16 and rim seal containment structure 20, and FIG. 10 shows the rim seal containment structure 20 alone prior to assembly. The impingement plate 16 as shown in FIG. 11 can be placed within the space along the aft portion 58 of the radially inward facing surface 26 of the ID vane platform 12.

In a second variant, as shown in FIG. 12-14, the forward edge 72 and the aft edge 74 of the cap portion 18 of the rim seal containment structure 20 are respectively received in first and second circumferentially extending slots 82, 84 formed on the radially inner vane platform 12. The slots 82, 84 may extend all the way from the pressure side to the suction side of the ID vane platform 12. The slots 82, 84 are configured secure the radial position of the rim seal containment structure 20 during operation. In the shown example, the rim seal containment structure 20 is formed from a single sheet of metal having a first portion defining a cap portion 18, and a second portion bent radially inward from the first portion to define a leg portion 68, similar to the previously described embodiment shown in FIGS. 8 and 10. In an alternate embodiment (not shown), the cap portion 18 and the leg portion 68 may be separately formed and subsequently joined, similarly to the previously described embodiment shown in FIGS. 3 and 4.

The rim seal containment structure 20 may be attached to the ID vane platform 12 by welding or brazing. The weld or braze joint is typically provided all around the rim seal containment structure 20, including at the interface with the tabs 62, 64, to prevent leakage. Assembling the rim seal containment structure 20 within the slots 82, 84 ensures that the weld or braze joint is in compression and not in tension, which reduces the risk of weld/braze failure. Furthermore, constraining the rim seal containment structure 20 within the slots 82, 84 prevents complete separation of the rim seal containment structure 20 from the vane in the event of a weld/braze attachment failure. The rim seal containment structure 20 may be assembled on the vane by tangentially sliding the rim seal containment structure 20 from the pressure side to the suction side of the ID vane platform 12, or vice versa. The slots 82. 84 and the rim seal containment structure 20 may be cut to the same radii to ensure easy assembly.

In all of the embodiments described above, the rim seal containment structure 20 provides the sealing capabilities to a large area of the radially inward facing surface 26 of the ID vane platform 12 covering the majority, if not the full, area of the aft portion 58 of the ID vane platform 12. The cooling cavity 25 defined between the rim seal containment structure 20 and the impingement plate 16 may be in communication with an internal cavity or cooling channel of the airfoil 28 to receive a cooling fluid therefrom. The cooling fluid from the cooling cavity 25 may impinge on a backside of the ID vane platform 12 via the impingement plate 16 to provide an effective cooling of the ID vane platform 12.

The rim seal feature 14 also allows for axial disassembly of the vane and blade without a cover lift. Embodiments described above display methods for more effective backside cooling to the ID vane platform 12 above the rim seal feature 14. This leads to reduced local hot side temperatures, increased life parts, reduced cooling air consumption, and improved performance. By integrating the containment cap 18 with the rim seal feature 14, better cooling is delivered to the aft portion 58 of the ID vane platform 12 while maintaining the performance of the rim seal feature 14.

A seal arrangement for the turbine engine may include a plurality of vanes 10 and adjacent blades assemblies around a rotor disc 74. The rim seal containment structure 20 combined with the rim seal feature 14 allow for further cooling of the aft portion 58 of the ID vane platform 12 that has been under cooled. Less additional holes may be necessary to cool this particular area and less coolant may be necessary to use allowing for improved efficiency.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A seal arrangement for a turbine engine, comprising:

a non-rotatable vane assembly including a vane comprising:

a radially inner vane platform having a radially outward facing surface, a radially inward facing surface, a forward portion, and an aft portion;

a radially outer vane platform;

an airfoil including a pressure side surface and an opposite suction side 46 surface generally extending axially from a leading edge to a trailing edge of the airfoil and radially from an inner diameter base to an outer diameter tip (54), wherein the airfoil is positioned between and joined to the radially inner vane platform and radially outer vane platform;

a rim seal feature comprising:

a forward rim seal leg comprising a pressure side tab and a suction side tab, each tab being positioned at a circumferential edge of the radially inward facing surface of the radially inner vane platform, and extending radially inward from the airfoil of the vane;

an aft rim seal leg extending along the length of the radially inward facing surface of the radially inner vane platform circumferentially from a pressure side to a suction side of the radially inner vane platform, the aft rim seal leg extending radially inward from the airfoil of the vane at an aft end of the radially inner vane platform;

an impingement plate covering the radially inward facing surface of the radially inner vane platform, and extending axially aft up to the aft rim seal leg;

a rim seal containment structure located radially inward of the impingement plate, the rim seal containment structure comprising a cap portion extending axially over the aft portion of the radially inner vane platform up to the aft rim seal leg, the rim seal containment structure further comprising a leg portion extending radially inward from the cap portion and positioned axially between a forward edge and an aft edge of the cap portion, the leg portion extending in a circumferential direction between the pressure side tab and the suction side tab, such that the leg portion of the rim seal containment structure, the pressure side tab and the suction side tab, in combination, form the forward rim seal leg, wherein the forward rim seal leg, the radially inward facing surface of the radially inner vane platform and the aft rim seal leg define a rim cavity, and wherein a cooling cavity is defined between the rim seal containment structure and the impingement plate, the cooling cavity extending axially aft up to the aft rim seal leg, to provide cooling to the aft portion of the radially inner vane platform.

2. The seal arrangement according to claim 1, wherein the leg portion is separately formed from the cap portion and is joined thereto by welding or brazing.

3. The seal arrangement according to claim 2, wherein a radial extension of the leg portion of the rim seal containment structure corresponds to a radial extension of the pressure and suction side tabs.

4. The seal arrangement according to claim 1, wherein the rim seal containment structure is formed of a monolithic sheet comprising: a first portion located at a first radial level that defines the cap portion, and a second portion bent radially inward from the first portion and extending to a second radial level, to define the leg portion.

5. The seal arrangement according to claim 1, wherein the forward edge and the aft edge of the cap portion of the rim seal containment structure are respectively received in first and second circumferentially extending slots formed on the radially inner vane platform, the slots being configured to secure a radial position of the rim seal containment structure.

6. The seal arrangement according to claim 1, wherein the rim seal containment structure is welded or brazed to the radially inner vane platform.

7. The seal arrangement according to claim 1, wherein the cooling cavity is in communication with an internal cavity of the airfoil to receive a cooling fluid therefrom, whereby the cooling fluid from the cooling cavity impinges on a backside of the radially inner vane platform via the impingement plate.

8. A turbine stage of a gas turbine engine, comprising:

a vane assembly defined about an axis and comprising:

a radially inner vane platform having a radially outward facing surface, a radially inward facing surface, a forward portion, and an aft portion;

a radially outer vane platform;

an airfoil extending between the radially inner vane platform and the radially outer vane platform;

a rim seal feature comprising:

a forward rim seal leg comprising a pressure side tab and a suction side tab, each tab being positioned at a circumferential edge of the radially inward facing surface of the radially inner vane platform, and extending radially inward from the airfoil of the vane;

an aft rim seal leg extending along the length of the radially inward facing surface of the radially inner vane platform circumferentially from a pressure side to a suction side of the radially inner vane platform, the aft rim seal leg extending radially inward from the airfoil of the vane at an aft end of the radially inner vane platform;

an impingement plate covering the radially inward facing surface of the radially inner vane platform, and extending axially aft up to the aft rim seal leg;

a rim seal containment structure located radially inward of the impingement plate, the rim seal containment structure comprising a cap portion extending axially over the aft portion of the radially inner vane platform up to the aft rim seal leg, the rim seal containment structure further comprising a leg portion extending radially inward from the cap portion and being positioned axially between a forward edge and an aft edge of the cap portion, the leg portion extending in a circumferential direction between the pressure side tab and the suction side tab, such that the leg portion of the rim seal containment structure, the pressure side tab and the suction side tab, in combination, form the forward rim seal leg, wherein the forward rim seal leg, the radially inward facing surface of the radially inner vane platform and the aft rim seal leg define a rim cavity, wherein a cooling cavity is defined between the rim seal containment structure and the impingement plate, the cooling cavity extending axially aft up to the aft rim seal leg, to provide cooling to the aft portion of the radially inner vane platform; and a blade assembly disposed axially downstream of the vane assembly, the blade assembly including a blade platform comprising an angel wing extension having a distal end projecting in the upstream direction spaced radially inward from the aft portion of the radially inner vane platform.

9. The turbine stage according to claim 8, wherein the forward edge and the aft edge of the cap portion of the rim seal containment structure are respectively received in first and second circumferentially extending slots formed on the radially inner vane platform, the slots being configured to secure a radial position of the rim seal containment structure.

10. The turbine stage according to claim 8, wherein the leg portion is separately formed from the cap portion and is joined thereto by welding or brazing.

11. The turbine stage according to claim 10, wherein a radial extension of the leg portion of the rim seal containment structure corresponds to a radial extension of the pressure and suction side tabs.

12. The turbine stage according to claim 8, wherein the rim seal containment structure is formed of a monolithic sheet comprising: a first portion located at a first radial level that defines the cap portion, and a second portion bent radially inward from the first portion and extending to a second radial level, to define the leg portion.

13. The turbine stage according to claim 8, wherein the rim seal containment structure is welded or brazed to the radially inner vane platform.

14. The turbine stage according to claim 8, wherein the cooling cavity is in communication with an internal cavity of the airfoil to receive a cooling fluid therefrom, whereby the cooling fluid from the cooling cavity impinges on a backside of the radially inner vane platform via the impingement plate.

* * * * *